US005667341A

United States Patent [19]

Kuehn

[11] Patent Number: 5,667,341

[45] Date of Patent: Sep. 16, 1997

[54] APPARATUS FOR SIGNAL AND DATA TRANSMISSION FOR CONTROLLING AND MONITORING UNDERWATER PILE DRIVERS, CUT-OFF EQUIPMENT AND SIMILAR WORK UNITS

[76] Inventor: Hans Kuehn, Tierparkallee 27, D-22527 Hamburg, Germany

[21] Appl. No.: 481,270

[22] PCT Filed: Jan. 3, 1994

[86] PCT No.: PCT/DE94/00002

§ 371 Date: Jul. 3, 1995

§ 102(e) Date: Jul. 3, 1995

[87] PCT Pub. No.: WO94/16193

PCT Pub. Date: Jul. 21, 1994

[30] Foreign Application Priority Data

Jan. 5, 1993 [DE] Germany ..... 43 00 074.6

[51] Int. Cl.[6] ..... B63G 8/00; E02D 7/06

[52] U.S. Cl. ..... 405/228; 405/232; 294/66.2

[58] Field of Search ..... 405/228, 232, 405/158, 172, 188, 191, 195.1; 294/66.2

[56] References Cited

U.S. PATENT DOCUMENTS

| | | | |
|---|---|---|---|
| 3,314,240 | 4/1967 | Bardgette | 61/53.5 |
| 3,354,658 | 11/1967 | Leonardi | 405/191 |
| 3,520,358 | 7/1970 | Brooks et al. | 405/191 X |
| 3,550,386 | 12/1970 | Ballinger | 405/191 |
| 3,998,064 | 12/1976 | Jansz | 61/53.5 |
| 4,157,287 | 6/1979 | Christenson | 405/228 X |
| 4,502,407 | 3/1985 | Stevens | 114/222 |
| 4,618,285 | 10/1986 | Ahlstone | 405/191 |
| 4,721,055 | 1/1988 | Pado | 405/191 |
| 4,817,734 | 4/1989 | Kuehn | 405/228 X |
| 4,818,149 | 4/1989 | Kuehn | 405/228 |
| 4,872,514 | 10/1989 | Kuehn | 405/228 X |
| 4,921,438 | 5/1990 | Godfrey et al. | 439/190 |
| 5,052,941 | 10/1991 | Hernandez-Marti et al. | 439/194 |
| 5,074,713 | 12/1991 | Reis | 405/191 X |
| 5,092,711 | 3/1992 | Langner | 405/191 X |
| 5,145,007 | 9/1992 | Dinkins | 166/386 |
| 5,209,673 | 5/1993 | Mohn | 439/199 |
| 5,370,545 | 12/1994 | Laurent | 439/190 |

FOREIGN PATENT DOCUMENTS

| | | | |
|---|---|---|---|
| 8301622 | 9/1983 | Netherlands | 405/228 |

*Primary Examiner*—Frank Tsay

*Attorney, Agent, or Firm*—Whyte Hirschboeck Dudek S.C.

[57] ABSTRACT

Signals and data for controlling and monitoring underwater ramming and cutting-off machinery (1) or the like are transmitted from above the water surface to submerged underwater machinery (1) by transmission lines bound in an umbilical cable (4). These lines are very sensitive and are often destroyed after a short time already by rough offshore handling under the heavy load of the machinery. The proposed invention allows said lines to be taken away from the umbilical cable (4) and to ensure transmission through lines which are more carefully handled. For that purpose, the lines available in the umbilical cable (5) of the communication system of a remote controlled underwater vehicle (6) provided with a television camera which is indispensable for observing underwater operations are used. The umbilical cable (5) of the underwater vehicle (6) extends separately to the water surface and is handled in a substantially more careful manner. The connection (7) between the machinery (1) and the underwater vehicle (6) may be established at any moment, also under water. The connection (7) is established under water by means of the robot system (8) of the underwater vehicle (6).

17 Claims, 4 Drawing Sheets

9
10
48
4
15
14
12
11
63
3
A
5
6
7
8
1
6a
2
20
19
16
49
B
18
17
21

APPARATUS FOR SIGNAL AND DATA TRANSMISSION FOR CONTROLLING AND MONITORING UNDERWATER PILE DRIVERS, CUT-OFF EQUIPMENT AND SIMILAR WORK UNITS

This application is an application under 35 U.S.C. §371 of international application no. PCT/DE94/00002 designating the U.S. filed on Jan. 3, 1994, now abandoned.

BACKGROUND OF THE INVENTION

The invention deals with an apparatus for the transmission of signals and data for the control and monitoring of underwater pile drivers and cut-off equipment or similar work units from above the water surface to the underwater equipment lowered to below the water surface, or vice versa.

For more than 10 years underwater pile driving has been considered an established process in offshore foundation work. However, experience has shown that umbilicals, required for the operation of underwater pile drivers, are quite susceptible to damage. The deeper the underwater operation, the higher the costs incurred for repair or replacement of the long umbilical, and for downtime which alone can be as high as U.S. $ 17,000. per working hour.

This vulnerability is mainly due to the sensitivity of signal and control lines contained in the umbilical. Electrically controlled pile drivers are hardest hit, because they fail as soon as the electrical supply of the control equipment is impaired, or disruptions occur, because control processes have ceased. This is also true for electric control processes of automatically controlled equipment, except that its operation is not interrupted.

This vulnerability affects other underwater work units also, especially underwater cut-off equipment which will be utilized more often in the future under similar working conditions when redundant drilling platforms are removed.

Experience has shown that air pressure lines installed inside the umbilicals and electric power cables for operating a submerged underwater drive unit, rarely cause failures. However, some of the much thinner signal and control cables are often damaged and not useable, sometimes even before the operation begins.

This is because they are already damaged by the rough handling onboard and during the lowering of the equipment such handling causes the umbilical to hook, catch, or twist around objects onboard, around the underwater structure or the equipment itself. During the operation and subsequent raising of the equipment, they are further jeopardized.

Efforts to remedy the situation were concerned mainly with the umbilical design and the corresponding proving tests with the result that, no matter where and how the thin signal wires are arranged in the umbilical cross-section, they are always the weakest link between the rugged reinforcement, mostly designed for large tensile forces, and the other more rugged lines. Furthermore, an arrangement yielding a completely uniform load distribution can be achieved neither through design nor manufacturing technique. Their increased susceptibility to damage is therefore unavoidable.

Therefore many more signal wires are provided than required, a measure which is intended to prevent failure, but in fact only postpones it.

Damage to the umbilical and repair cost are accepted as unavoidable in practice. The cumulative cost of damage and downtime up to now are in the millions of dollars and spoil the economic viability of underwater work units, especially that of pile drivers. This is even more true when the failure occurs in an umbilical, which is used in the operation of an additional underwater drive unit mentioned before, and which may cost up to U.S. $ 1400 per meter, depending on the transmitted power.

Repairs made by patching damaged wires are only conditionally successful. They adversely affect the strength of the sheathing and weaken its ability to transmit tensile forces. Often patching is responsible for repeated failures with corresponding downtime. Furthermore, the diameter of the umbilical is considerably increased over a certain length in the vicinity of the patch, which can lead to difficulties when winding it on a drum, especially if there is a winding-on device on the drum.

In order to be able to complete the work at hand in such cases, one sometimes resorts to an additional cable installed parallel to the umbilical, containing the required signal wires. Apart from the fact that this cable and the accompanying cable drum and guide installation must be provided and installed additionally in the crane boom, additional personnel is also required. The cable causes problems because, due to its low specific gravity, it drifts in the water uncontrollably, unless it is provided with additional weight or connected to a steel rope. Such improvisations, made at the work site, are only possible when working in more shallow water depth.

All in all the current situation is highly unsatisfactory both technologically and economically.

SUMMARY OF THE INVENTION

The object of this invention is to provide an apparatus for signal and data transmission to be used with equipment of the aforementioned kind, which makes it possible to transmit signals and data more reliably and cheaper and therefore more economically.

According to the present invention, an apparatus is disclosed for transmitting signals and data to control and monitor underwater work units from a support ship to the underwater work units, separately from apparatus for transmitting drive energy, having at least a pair of umbilicals. A first umbilical has signal and control lines for the transmission of signals and data from a control station on the support ship to the underwater work unit. A second umbilical carries drive energy from the support ship to the work unit for supplying compressed air and/or drive energy, such as hydraulic energy and/or electrical power to the work unit. The apparatus also includes an intermediate relay situated under water and connected to the first umbilical to relay the signals and data from the control station, through the intermediate relay and to the underwater work unit, wherein the underwater work unit is detachably connected to the intermediate relay which comprises an independent communication system.

With this apparatus the underwater equipment involved can be controlled more safely with fewer interruptions and lower equipment cost, and data can be transmitted more reliably. Further advantageous embodiments of the apparatus are described in the claims.

BRIEF DESCRIPTION OF THE DRAWINGS

Preferred application examples of the apparatus according to the invention are explained using attached drawings.

DETAILED DESCRIPTION OF THE PREFERRED EMBODIMENT

Figures 1, 2, 3:
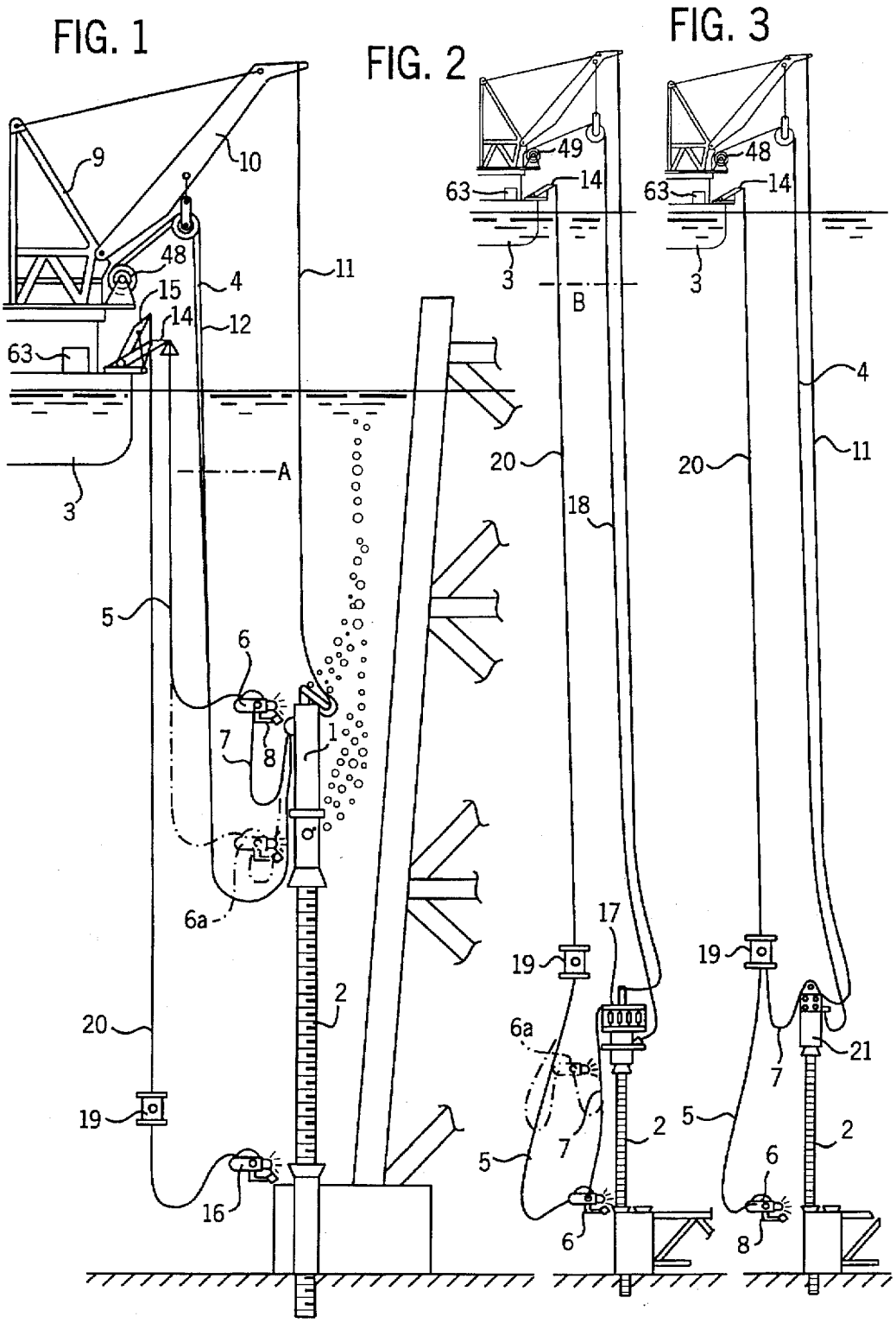
FIG. 1 shows schematically a pile driver set on top of a foundation pile of an underwater structure, and connected with an underwater vehicle by means of a line.
FIG. 2 shows a smaller representation, similar to FIG. 1, of a pile driver equipped with an underwater drive unit.
FIG. 3 shows a representation, similar to FIG. 2, of a pile driver which is connected with the launch cage of an underwater vehicle.

In FIG. 1, pile driver 1 is free standing on top of the foundation pile 2. Normally, signal transmission takes place from support ship 3 to pile driver 1 by means of lines contained in the umbilical 4. In the presented embodiment, however, the pile driver 1 is connected with the umbilical 5 of an underwater vehicle 6 which is equipped with a television camera, by means of the connection line 7. Since vehicle 6 is mandatory for the observation of the pile driving operation, it is possible to combine the communication system of the underwater camera/vehicle system with connection line 7 for signal transmission to control station 63 on the support ship 3. Provided transmitted signals are not too extensive, the umbilical 5 can be used for this purpose as is. Otherwise it can be replaced with a more effective one for little additional cost.

The advantage is that the sensitive signal lines are removed from the endangered pile driver umbilical 4 and therefore are not included in the high risk handling procedure. They shall be connected outboard at any time with the pile driver 1, e.g. utilizing robot tool 8 of the underwater vehicle 6. The safest time is the time when the equipment has been set on the foundation pile 2 and is ready for operation. This is possible because the compressed air supply during lowering of pile driver 1, needed for compensating for the external water pressure, is regulated automatically and is checked optically by the underwater camera.

The following advantages are obtained in return for minor expenditure.

- The vehicle umbilical 5 contains only thin lines without exception, so that non-uniform loading due to the rugged and thin line combination is not a problem.
- The vehicle umbilical 5 will be handled much more carefully, because of the much more sensitive type of equipment, than the heavy load of the pile driver 1.
- The vehicle umbilical 5 is exposed to less handling risks because the whole installation is located in an always safe location directly by the side of the ship, whereas the pile driver 1 with its umbilical 4 rigidly attached is often placed on deck for space reasons, which is not very handling-friendly as far as the umbilical 4 goes.
- The vehicle umbilical 5 is shorter than umbilical 4, which, in most cases, is lowered from the crane 9 by way of the boom 10, which means a longer length is at risk of damage.
- The number of lines in the vehicle umbilical 5 is sufficient for the transmission of a moderate number of signals, i.e. this cable can possibly be used as is.
- The vehicle umbilical 5 is less expensive than the umbilical 4.
- Additionally, when equipment is adequately outfitted and a conventional umbilical of any kind is damaged, there is the possibility of changing over to the invention's technique as an immediately available alternative without incurring substantial downtime cost.

In order for the underwater vehicle 6 to be able to execute its primary task of monitoring without significant difficulties, the connection line 7 is made as long as required for the intended sphere of operation. It permits vehicle 6 to move to position 6*a* for the purpose of checking the lifting rope 11, the umbilical 4, the pressure medium hoses 12 for driving the pile driver 1, and the escape of superfluous compressed air 13, without having to operate the lifting or lowering mechanism 14 on board.

The second vehicle 16 which is suspended from the lifting and lowering mechanism 15, is used for monitoring the pile penetration with the help of markings on foundation pile 2.

In case of failure of one or the other vehicle, the intact vehicle will take on the task of the failed one for the time being. For this reason both vehicles are equipped equally.

In FIG. 2, pile driver 1, in contrast to FIG. 1, is not powered from aboard by means of a long pressure medium circuit with long hoses 12, but by means of an underwater drive unit 17 mounted on it and a short pressure medium circuit. The energy for the electro-hydraulic drive unit 17 for generating the pressure medium flow is supplied by the umbilical 18. It contains not only electric power lines and a compressed air line but conventionally also signal lines. According to this invention the latter lines drop out and signals are transmitted, as in FIG. 1, by means of connection line 7 to the underwater vehicle 6. Unlike in FIG. 1, the underwater vehicle 6 is connected with the support ship 3 by way of the submerged launch cage 19, so that the signal is transmitted by way of the umbilical 5, the launch cage 19 and its lifting umbilical 20.

In deeper water the submerged launch cage 19 transports the underwater vehicle 6 in the vicinity of the work location where it is released to the area of activity. After completion of its tasks the vehicle 6 returns to the launch cage 19 and, locked to it, is lifted back to the support ship. Difficulties for the underwater vehicle 6 are thereby prevented which would occur without the launch cage because of underwater current acting on a relatively long and light umbilical 5. It would be difficult to maintain its position unless it had stronger propeller drives which has disadvantages from a construction viewpoint. i.e. this embodiment is similar to FIG. 1 in regard to line positioning and length of 5 and 7.

The vibration pile driver 21 shown in FIG. 3 is not connected with the underwater vehicle 6, in contrast to FIGS. 1 and 2, but with the launch cage 19. This has the advantage that the connection line 7 can be provided with more line arteries, because weight, stiffness and diameter of the connection line do not matter so much, since it does not inhibit the maneuverability of vehicle 6.

The launch cage 19 is capable of carrying more powerful drums for winding the connection line on and off and supplying them with energy. The lifting umbilical 20, which is connected to it, does not only contain more lines than umbilical 5, but it has significantly more reinforcement for higher tensile forces. Apart from electric lines it can contain thinner pressure medium lines to enable not only an electric, but also a pressure medium, signal line. It is therefore more universal and powerful and vehicle 6 remains uninhibited in its freedom of movement.

The connection line 7 is connected to the pile driver 21, as before, by vehicle 6 utilizing its robot tool 8.

Figure 4:
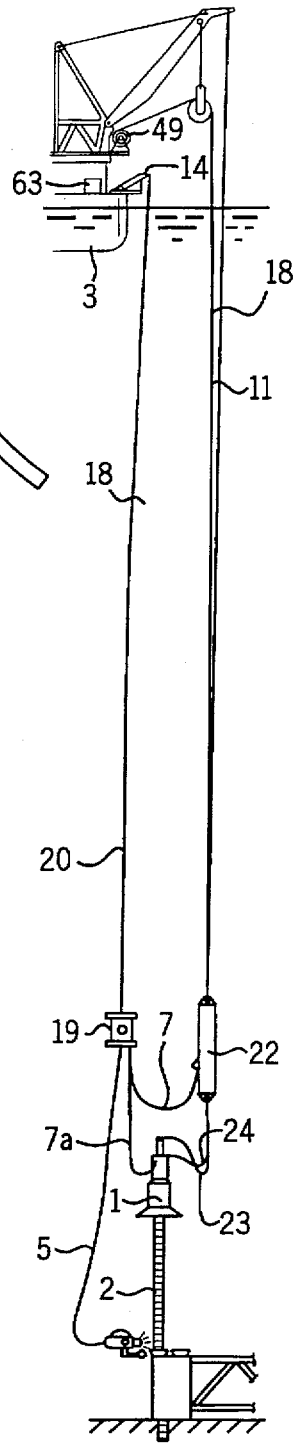
FIG. 4 shows a representation, similar to FIG. 3, with an underwater drive unit suspended next to the pile driver and connected with the launch cage of an underwater vehicle.

FIG. 4 shows the pile driver 1 connected with a separate underwater drive unit 22 installed in a piece of pipe as a special equipment component. The closed pressure medium circuit for powering the pile driver 1 is established by hoses 23. The energy is supplied to drive unit 22 by means of umbilical 18, as in FIG. 2, which no longer contains signal lines, because in this case signals are transmitted by means of connection line 7 from the launch cage 19 to, for example, the drive unit 22. It is a variation which is not only more universal and effective as far as signal transmission is concerned, as described in FIG. 3, but furthermore incorporates a connection line 7 with plug connectors on both ends connected to "quiet" components which do not participate in the hammer vibrations of the pile driver 1. The use of this variation is advantageous in all those cases where one is afraid that, e.g. during long and difficult pile driving where considerable recoils are expected, the cushioning measures in the pile driver 1 and in the drive unit 22 are not sufficient over a long period of time and that for these reasons the drive unit 22, in contrast to FIG. 2, is a separate unit. The signals of the drive unit 22 are then transmitted by means of a "recoil free" line 7; the signals of the pile driver 1 are still transmitted by means of a line 24 which is exposed to vibrations, but which need not be plugged in, but can be rigidly connected, because pile driver 1 and drive unit 22 are always raised and lowered together.

Figure 6:
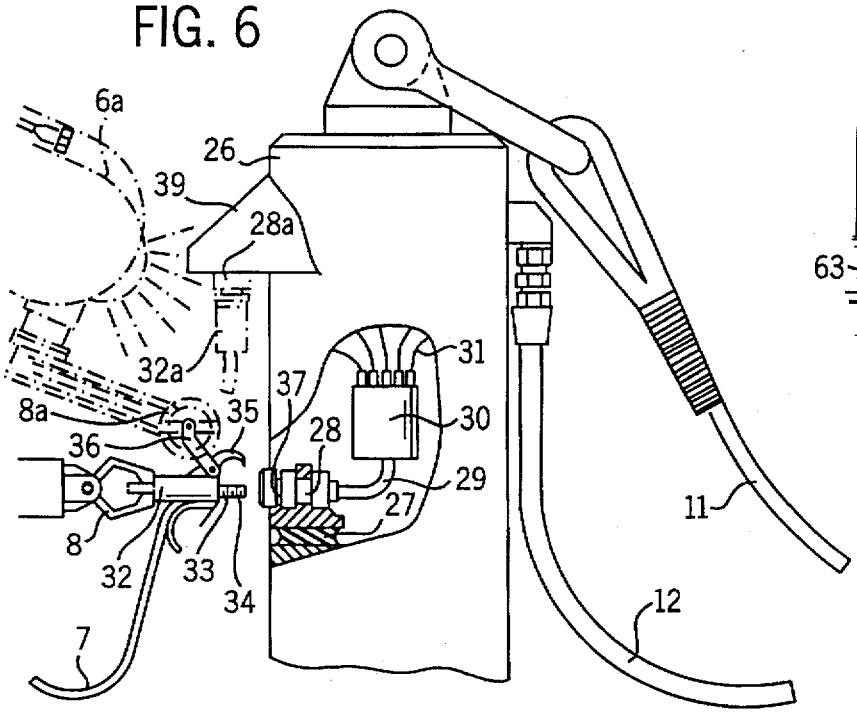
FIG. 6 shows a portion of a pile driver or cut-off equipment with line connections which can be plugged in underwater.

Of course signals may be transmitted directly to pile driver 1, as in FIG. 3, by means of connection line 7*a*, as is possible in the above mentioned difficult applications, provided the plug connection is correspondingly cushioned or connected advantageously (see also FIG. 6).

If required, both the drive unit 22 and the pile driver 1 may be connected to launch cage 19 by means of lines 7 and 7*a* simultaneously, thereby making line 24 redundant, so that a more flexible mode of signal transmission is possible.

FIGS. 2 and 4 each show only one underwater vehicle 6 with television camera for the monitoring pile driving progress and the pile driver 1, 21. If a failure occurs, pile driving conventionally stops, because one cannot work when "blind". Therefore nothing changes when applying the invention instead of the conventional technique. For repairs the underwater vehicle 6 must be taken onboard as usual. However, in this case the connection at the launch cage must be detached or the connection line 7 must be severed automatically, because the connection at the pile driver cannot be detached anymore for lack of vision or maneuverability. This is what is conventionally done with the umbilical 5 if it or the underwater vehicle 6 catches somewhere, so that it can float up after a certain time.

When repairing the connection line 7, a prepared replacement unit, e.g. consisting of an easily mountable, complete winding on and off device including the connection line 7, is installed in the launch cage 19 in exchange for the existing unit so that no additional time is lost.

The severed connection line is not of significant value. It is short and contains relatively few lines. The plug that remained on the pile driver is unplugged when the repaired underwater vehicle returns to the work location and makes the new connection.

The detachment and reconnection procedures and the replacement parts are a minor expense relative to the expense incurred when an umbilical 4, 18 fails, so that the advantages gained through this technique are hardly diminished.

Figure 5:
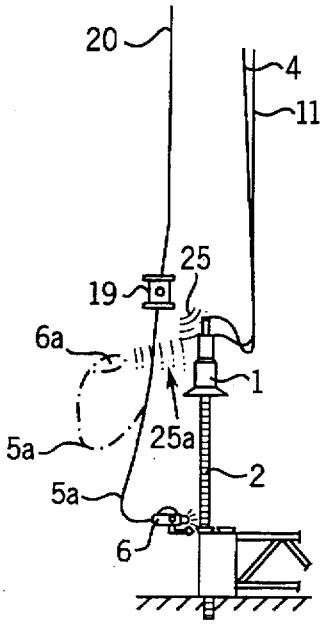
FIG. 5 shows a representation, similar to FIG. 3, of a pile driver which is connected by means of underwater radio.

FIG. 5 shows a pile driver which is not connected by means of connection lines 7, 7*a*, unlike in previous FIGS. 1 to 4, but shows transmission of radio signals 25 between launch cage 19 and pile driver 1. Such a transmission is suitable in locations where only one or very few signals are to be transmitted. This is the case with equipment which is controlled automatically, e.g. by using the pressure medium which is used for powering the pile driver which requires only occasional adjustment for changing the impact energy. For this equipment a line connection 7 need to be established, in fact, only occasionally, as needed, so that a radio connection seems appropriate, since it avoids the plugging procedure completely. Since all other operating functions are controlled automatically, and partly monitored optically using the television camera, this is the simplest possible method of communication which has been made possible by this invention.

Radio signals can also be transmitted between underwater vehicle 6 and pile driver 1, of course, as indicated by their positions 5*a*, 6*a* and 25*a*, and to required equipment, e.g. the drive unit 22, according to FIG. 4, and others.

FIG. 6 shows the head 26 of a pile driver or cut-off equipment with a horizontal underwater plug connector 28, fastened to an elastic pad 27, which is connected to a junction box 30 by means of a gathering line 29. Lines 31 branch off from this box to signal transmitters or receivers of the equipment. The plug 32 with connection line 7 for the wet-connectable connector has preferably a coaxial cylindrical pin 33, which is equipped with a number of ring contacts 34 corresponding to the number of signals to be transmitted, and whose reciprocal poles are located in the socket 28. The advantage of this embodiment is the fact that during remote controlled plugging in less attention needs to be paid to angular and lateral deviations compared with plug connectors with many individual pins. Furthermore, it is not necessary with this embodiment to pay attention to the plug orientation, as is required with multiple pin connectors, to ensure that individual pins connect with the correct reciprocal poles. But it goes without saying that any wet connectable connection can be considered. Preferable is the connection which connects reliably and in only a few minutes even though there is the disadvantage, just as in the case of the coaxial connector, that the electric supply must be interrupted during the plugging in operation.

Plugging in and unplugging the plug 28 is carried out with the help of the robot tool 8, 8*a* of the underwater vehicle 6, 6*a*, and the safety latch 35 is engaged or disengaged from the locking groove 37 with handle 36. The protective ledge 39 is provided in case the shackle 38 with lifting rope 11 is lowered on the other side during any operating phase. The protective ledge can be used for positioning the plug connector 28*a* and 32*a* vertically, which is favorable for resisting loads since the hammer blows are directed vertically also, but somewhat less favorable for manipulating robot tool 8.

With the techniques described previously under FIGS. 1 to 6, it is possible to show a selection of data gathered by the underwater equipment on pile driving, and to show television observations simultaneously on the video monitor of the control station while recording them on tape. This has an advantage for future investigations, because differences resulting from two sets of data from two different communication systems or recording devices are eliminated.

Figure 7:
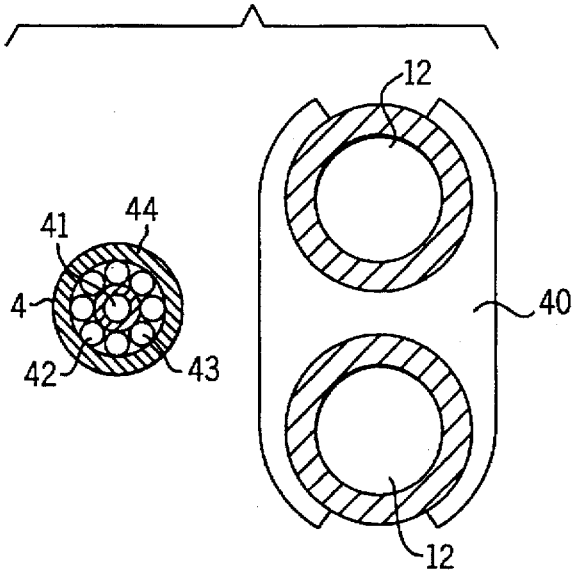
FIG. 7 shows a cross section, according to section "A" of FIG. 1, of lines of conventional type extending between support ship and pile driver.

FIG. 7 shows the pressure medium hoses 12 and the umbilical 4 in cross section. The hoses 12 are held together by means of clamps 40 spaced at a certain length. The umbilical 4 is next to it and loose. It can also be included in the clamps, just as all lines can be next to each other but also loose.

The long umbilical 4 contains a compressed air line 41, shielded as well as unshielded signal lines 42, 43 and has a tension reinforced wrapping 44. Its manufacture is demanding and its price correspondingly high. It has the above described susceptibilities in regard to signal lines 42 and 43.

Figure 8:
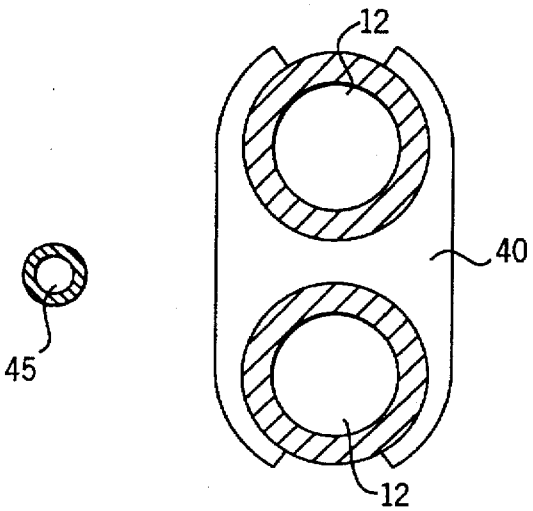
FIG. 8 shows a cross section, as in FIG. 7, of the type according to the invention.

FIG. 8 shows, apart from the pressure medium hoses 12, merely a single compressed air hose 45 which is coupled together using standard length sections, because the sensitive signal lines 42, 43 are contained in the communication system of the underwater television camera vehicle 6, according to the invention. This means, combined with lower total cost, additionally, when damaged, better repairability through quick replacement of cheap hose sections.

In place of the umbilical drum 48 with its expensive current collectors on the support ship 3, FIGS. 1 and 3, only a simple hose drum with a central compressed air feed is required.

Figure 9:
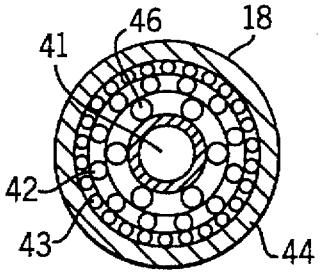
FIG. 9 shows a cross section, according to section "B" in FIG. 2, through lines of conventional type extending between support ship and pile driver according to FIGS. 2 and 4.

An umbilical 18, shown in FIG. 9 in cross section, contains electric power lines 46 for energy supply to an underwater drive unit 17/22 and is therefore significantly larger in diameter and also more heavily reinforced than umbilical 4 and is therefore also heavier and more resistant to bending.

Its manufacture is extremely demanding and it is therefore very expensive. This can lead to having to purchase minimum lengths, which often not needed, adversely affects economic efficiency, and in spite of all the effort, the described susceptibilities of the signal lines 42, 43 remain.

Figure 10:
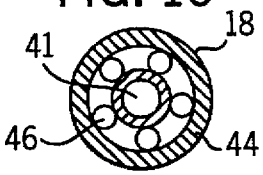
FIG. 10 shows a cross section, as in FIG. 9, of the type according to the invention.

The umbilical cross section according to this invention, FIG. 10, is simplified because signal lines 42/43 are eliminated and therefore can be manufactured considerably cheaper and can be designed to be more reliable.

Figure 11:
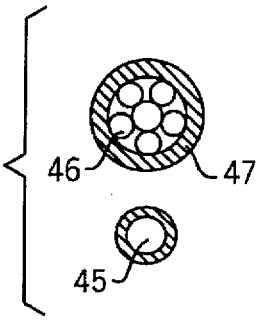
FIG. 11 shows a cross section, as in FIG. 10, of a different type according to the invention.

In place of the umbilical 18, FIG. 11 shows a compressed air line 45, as described in FIG. 8, and an ordinary cable 47 with electric power cables 46 arranged next to it. This variation according to the invention is by far the cheapest for this particular operating condition and is more favorable in terms of repairability and replacement cost than all previous variations. The constant tension umbilical drum 49, FIGS. 2 and 4, is less expensive, because it can be built much smaller for the same winding capacity; moreover, the many collectors for the signal lines are not needed and only the current collectors for the electric power cables remain.

On the other hand, there is the fact that, instead of handling only one umbilical 18, as in FIG. 10, two supply lines 45 and 47 need to be handled. However, clamping them together will simplify handling.

Figure 12:
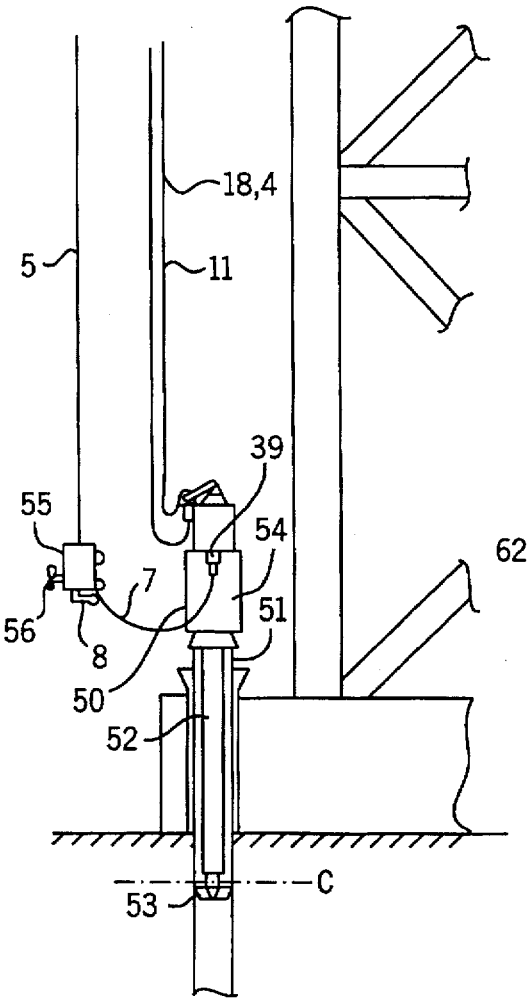
FIG. 12 shows in schematic representation cut-off equipment set on top of an installed foundation pile of an underwater structure and connected with an underwater vehicle by means of a line.

Corresponding with the diverse application possibilities, FIG. 12 shows underwater cut-off equipment 50 which is set on top of a driven foundation pipe pile 51 and whose shaft 52 with the cut-off tool 53 protrudes into it, so that it can be cut off below the sea floor in section C. The cut-off equipment 50 is equipped with an underwater drive unit 54 which is powered electrically or hydraulically from above the water surface. The electric energy is supplied by means of cables similar to umbilical 18 or 4 in FIGS. 1–5 (hoses for FIG. 4 are not shown).

The risk of damage to incorporated thin signal lines corresponds to that for pile drivers.

According to the invention, in this embodiment the umbilical 5 carries the signal lines to the underwater vehicle 55 which is mobile, for example by propeller drive 56, only to the extent necessary for maintaining position for observation with the TV camera, because the cut-off equipment 50 is also stationary during its operating phase, and for plugging the connection line 7 into the socket 39 at the cut-off equipment with its own tool 8. Actual observation is not necessary here because the work is performed inside the foundation pipe pile 51 and is monitored there by a camera which is installed in the cut-off tool. In case the connection line 7 can be attached by other means, the propeller drive 56 and the tool 8 are redundant, so that the vehicle 55 becomes a simple relay station which can perform other tasks also. See FIG. 13.

Figure 13:
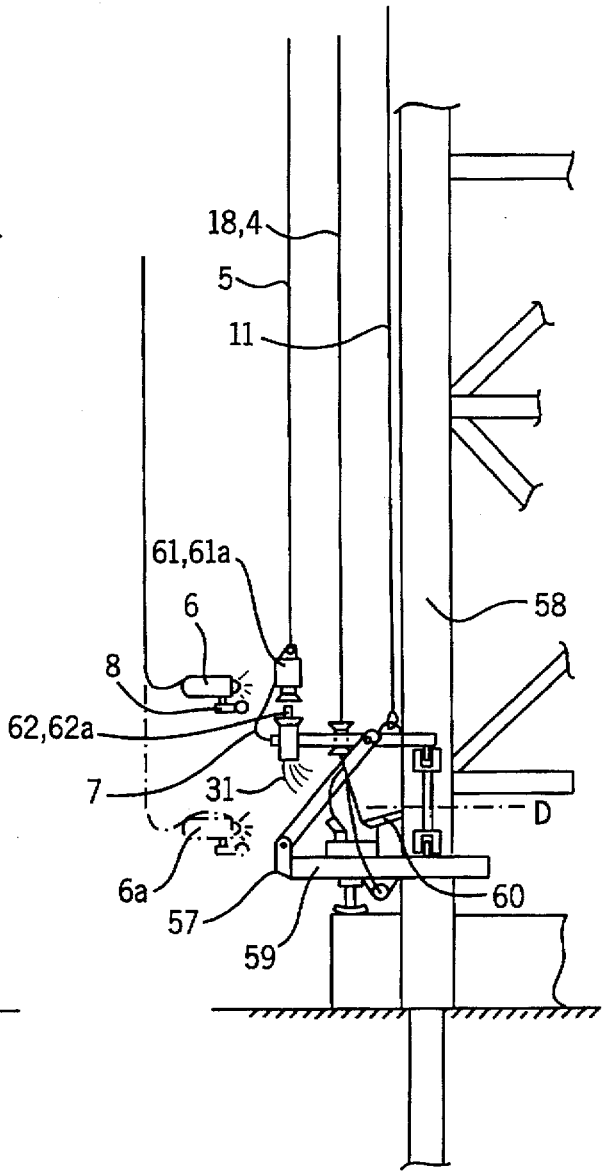
FIG. 13 shows in schematic representation different cut-off equipment clamped to the leg of a drilling platform and connected with a pressure or relay station.

The water jet cutting equipment 57 shown in FIG. 13 is clamped to the leg 58 of the drilling platform by means of clamps 59, and cuts the leg off in cutting plane "D" above the sea floor by means of its water jet cutting tool. The cut-off equipment can be powered as shown in FIG. 12 and the umbilicals 18 or 4 can be arranged accordingly. For the supply of the underwater cut-off tools 57, especially in deeper water, it can be useful to pressurize the water and add abrasive substances at the work location, in order to prevent large pressure losses in the long hoses coming down from above the water surface. This occurs in pressure station 61, which is directly and firmly connected with cut-off equipment 57 by means of the plug 62 of a plug connection. The signals of lines 31 are transmitted from cut-off equipment 57 to pressure station 61 by means of an external flexible line 7, and then transmitted by way of its communication system through the umbilical 5 or vice versa. One can also provide for a second fixed plug connection between cut-off equipment 57 and pressure station 61, just as was described before for the connection 62, or a universal plug connection where all lines are plugged together.

Since the cut-off equipment 57 is stationary when performing work, an observing camera as shown in FIG. 12 is not required.

However, before the work operation begins, as shown in the embodiment according to FIG. 12, the cut-off equipment 57 must be observed as it moves into the required cutting position at the leg 58 of the drilling platform. The underwater vehicle 6, which is equipped with television cameras, is needed for this purpose. It is subsequently used to maneuver the pressure station 61 into the correct position before lowering it to plug in the plug connector 62. Unplugging after the work is complete is affected by exerting a certain pulling force by means of a lifting device, e.g. similar to 14, 15 in FIGS. 1–5 onboard the support vessel 3, in order to unlock, for example, spring loaded indentation locking devices at the plug connector so that external observation for this, as of the work operation itself, is not necessary.

Instead of the pressure station 61, a relay station 61*a* can be similarly connected to the cut-off equipment by means of a plug connector 62*a*. This relay station 61 a communicates with the control station 63 on the support ship 3 by means of the umbilical 5 and ties in the television cameras, which are firmly affixed to the cut-off equipment 50 and 57 or to the underwater drive unit 17. At the same time additional signals which conventionally are transmitted by means of the umbilicals 4, 18, are instead transmitted by means of this system.

In case a relay station 61 a is used together with drive unit 17 in FIG. 2, depending on how it is supported an additional elastic support may be required to protect it from hammer vibrations.

On the whole, and especially in regard to work in deep water using underwater drive units, the new opportunities shift the limits of economic viability considerably and respond appropriately to the diversity of underwater applications.

I claim:

1. Apparatus for transmitting signals and data to control and monitor underwater work units from a support ship to the underwater work units separately from apparatus for transmitting drive energy, comprising:

a first umbilical having signal and control lines for the transmission of signals and data from a control station on the support ship to an underwater work unit;

a second umbilical connecting the support ship to the work unit and supplying drive energy thereto; and an intermediate relay situated underwater and connected to the first umbilical to relay the signals and data from the control station, through the intermediate relay and to the underwater work unit, wherein the underwater work unit is detachably connected to the intermediate relay, and wherein the intermediate relay comprises an independent communication system.

2. The apparatus of claim 1 wherein the second umbilical comprises a compressed air hose and a pair of pressure medium hoses.

3. The apparatus of claim 1 wherein the intermediate relay comprises an underwater vehicle having a camera connected to the first umbilical, and where in the first umbilical has signal and control lines for communication between the camera and the support ship.

4. The apparatus of claim 1 wherein the intermediate relay comprises a launch cage through which an underwater vehicle is connected with the support ship, and the first umbilical acts as a lifting umbilical for the launch cage.

5. The apparatus of claim 1 wherein the intermediate relay comprises a pressure station having a plug connector at its lower end connectable with the underwater work unit.

6. The apparatus of claim 1 further comprising a connection line detachably connected between the intermediate relay and the underwater work unit.

7. The apparatus of claim 1 wherein the intermediate relay relays the signals and data to the underwater work unit by way of wireless radio signals.

8. The apparatus of claim 3 wherein the underwater vehicle further comprises a robot tool for connecting and disconnecting the second umbilical from the underwater work unit.

9. The apparatus of claim 3 further comprising a wet connectable plug connection between the detachable connection line and the underwater work unit.

10. The apparatus of claim 9 wherein the wet connectable plug connection comprises a plug connection and a socket connection, wherein the socket connection is elastically affixed to the underwater work unit.

11. The apparatus of claim 10 wherein the plug connection comprises a coaxial cylindrical pin having a number of ring contacts corresponding to a number of signals to be transmitted.

12. The apparatus of claim 10 wherein the plug connection has a safety latch engageable with a locking groove of the socket connection.

13. The apparatus of claim 5 further comprising a second socket and plug connector between the pressure station and the underwater work unit for transmitting signals and data to the underwater work unit.

14. The apparatus of claim 13 further comprising an external, detachable flexible line between the pressure station and the second socket and plug connector.

15. The apparatus of claim 5 wherein the plug connector is elastically affixed to the underwater work unit.

16. The apparatus of claim 5 wherein the pressure station is detachable from the underwater work unit with the application of a pulling force on the first umbilical.

17. The apparatus of claim 1 wherein the second umbilical comprises a compressed air hose and a at least one electrical power cable.

* * * * *